US005883070A

United States Patent [19]

Urfer et al.

[11] Patent Number: 5,883,070

[45] Date of Patent: Mar. 16, 1999

[54] PROCESS FOR PREPARING ZEOLITE SLURRIES USING A NONIONIC SUGAR SURFACTANT AND ELECTROLYTE

[75] Inventors: Allen D. Urfer, Plainfield, Ind.; Virginia Lazarowitz, Hatfield, Pa.

[73] Assignee: Henkel Corporation, Gulph Mills, Pa.

[21] Appl. No.: 947,379

[22] Filed: Oct. 8, 1997

[51] Int. Cl.[6] ..... C11D 11/00; C11D 3/12; C11D 3/22; C11D 3/32

[52] U.S. Cl. ..... 510/532; 510/418; 510/470; 510/502; 510/507

[58] Field of Search ..... 510/507, 470, 510/418, 532, 502; 252/246, 239, 200

[56] References Cited

U.S. PATENT DOCUMENTS

| | | | |
|---|---|---|---|
| 1,985,424 | 12/1934 | Piggott | 260/124 |
| 2,965,576 | 12/1960 | Wilson | 252/137 |
| 4,675,127 | 6/1987 | Kickle et al. | 252/174.17 |
| 4,889,925 | 12/1989 | Schmid et al. | 536/18.6 |
| 5,118,439 | 6/1992 | Urfer et al. | 252/174.17 |
| 5,194,639 | 3/1993 | Connor et al. | 554/66 |
| 5,266,690 | 11/1993 | McCurry, Jr. et al. | 536/18.6 |
| 5,334,764 | 8/1994 | Scheibel et al. | 564/487 |
| 5,449,763 | 9/1995 | Wulff et al. | 536/18.6 |
| 5,476,610 | 12/1995 | Schmid et al. | 252/174.25 |

*Primary Examiner*—Ardith Hertzog
*Attorney, Agent, or Firm*—Ernest G. Szoke; Wayne C. Jaeschke; Steven J. Trzaska

[57] ABSTRACT

A process for making a stabilized aqueous zeolite suspension involving: (a) providing an aqueous zeolite suspension; (b) providing at least one nonionic sugar surfactant; (c) providing at least one electrolyte; and (d) adding the sugar surfactant and electrolyte to the aqueous zeolite suspension to form a stabilized aqueous zeolite suspension.

18 Claims, No Drawings

PROCESS FOR PREPARING ZEOLITE SLURRIES USING A NONIONIC SUGAR SURFACTANT AND ELECTROLYTE

FIELD OF THE INVENTION

The present invention generally relates to a process for stabilizing aqueous zeolite suspensions. More particularly, the process involves the addition of a nonionic sugar surfactant in combination with an electrolyte to stabilize zeolite slurries.

BACKGROUND OF THE INVENTION

Zeolites, especially those of the zeolite A type, are commonly employed as builders in detergent compositions. They have largely replaced the use of the more conventional polyphosphates. Their advantages lie not only in their high calcium binding capacity, but also and in particular in their high ecotoxicological compatability.

Zeolites are typically manufactured from in the form of an aqueous suspension which may either be stored and marketed as such or may be subjected to spray drying. Zeolites have extremely poor solubility in water, so that suspensions of zeolites readily sediment. In the most favorable case, this leads to phase separation although, normally, considerable quantities of the solid sink to the bottom of the vessels in storage, harden and have to be subsequently removed, size-reduced and re-suspended which results in the expenditure of considerable amounts of time, effort and finances. In other cases, the viscosity of the suspensions increases to such an extent that transfer to another vessel or circulation by pumping is difficult, if not impossible, and in any event involves considerable product losses.

There has been no shortage of attempts in the past to stabilize aqueous zeolite suspensions in such a way that they remain stable in storage for a sufficient time and can be transported through pipes without blocking them.

SUMMARY OF THE INVENTION

The present invention is directed to a process for making a stabilized aqueous zeolite suspension involving the steps of:

(a) providing an aqueous zeolite slurry;

(b) providing at least one nonionic sugar surfactant;

(c) providing at least one electrolyte; and (d) adding (b) and (c) to (a).

The present invention is also directed to a stabilized aqueous zeolite suspension containing:

(a) zeolite;

(b) at least one nonionic sugar surfactant; and (c) at least one electrolyte.

DESCRIPTION OF THE INVENTION

Other than in the operating examples or where otherwise indicated, all numbers expressing quantities of ingredients or reaction conditions are to be understood as being modified in all instances by the term "about".

Zeolites are understood to be optionally water-containing alkali metal or alkaline earth metal alumosilicates corresponding to the formula:

$$M_{2/z}O.Al_2O_3.x\ SiO_2.yH_2O$$

in which M is an alkali metal or alkaline earth metal having a valency of z, x is a number of from about 1.8 to about 12 and y is a number of from 0 to about 8.

Typical examples of zeolites of which aqueous dispersion may be stabilized by the process according to the invention are the naturally occurring minerals clinoptilolite, erionite or chabazite. However, synthetic zeolites may also be employed, such as zeolite X, zeolite Y, zeolite $K_9$, mordenite and zeolite A.

The aqueous suspensions to be stabilized will generally contain from about 40 to about 80% by weight, preferably from about 50 to about 70% by weight, and most preferably from about 55 to about 65% by weight, of a zeolite.

The nonionic sugar surfactants which may be employed in the present invention may be selected from the group consisting of alkyl polyglycosides, polyhydroxy fatty acid amides ("glucamides") and mixtures thereof.

The polyhydroxy fatty acid amides which can be used in the compositions and processes according to the invention are compounds corresponding to formula I:

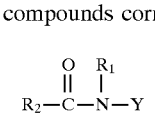

(I)

wherein: $R_1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Y is a polyhydroxyhydrocarbyl moiety having a linear hydrocarbyl chain with at least 3 hydroxyls directly connected to the chain, or an alkoxylated derivative (preferably ethoxylated or propoxylated) thereof. Y preferably will be derived from a reducing sugar in a reductive amination reaction; more preferably Y is a glycityl moiety. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Y. It should be understood that it is by no means intended to exclude other suitable raw materials. Y preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic mono- or poly- saccharide, and alkoxylated derivatives thereof. Most preferred are glycityls wherein n is 4, particularly $—CH_2—(CHOH)_4—CH_2OH$. Compounds of the formula I are also known as glucamides. Therefore, when, for example, $R_1$ is methyl, $R_2$ dodecyl; and Y is $—CH_2—(CHOH)_4—CH_2OH$, the compound in question is referred to as dodecyl N-methylglucamide.

Methods for making polyhydroxy fatty acid amides are known in the art. In general, polyhydroxy fatty acid amides can be made by reductively aminating a reducing sugar reacting with an alkyl amine to form a corresponding N-alkyl polyhydroxyamine and then reacting the N-alkyl polyhydroxyamine with a fatty aliphatic ester or triglyceride to form the N-alkyl, polyhydroxy fatty acid amide. Processes for making polyhydroxy fatty acid amides are disclosed in U.S. Pat. Nos. 1,985,424; 2,965,576; 5,194,639; and 5,334,764, the entire contents of each of which is incorporated herein by reference.

The alkyl polyglycosides which can be used in the invention correspond to formula II:

$$R_3O(R_4O)_b(Z)_a \qquad \text{(II)}$$

wherein $R_3$ is a monovalent organic radical having from about 6 to about 30 carbon atoms; $R_4$ is a divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention correspond to formula II wherein Z is a glucose residue and b is zero. Such alkyl polyglycosides are commercially available, for example, as APG®, GLUCOPON®, PLANTAREN® or AGRIMUL® surfactants from Henkel Corporation, Ambler, Pa., 19002. Examples of such surfactants include but are not limited to:

1. GLUCOPON® 220 Surfactant—an alkyl polyglycoside in which the alkyl group contains 8 to 10 carbon atoms and having an average degree of polymerization of 1.5.
2. GLUCOPON® 225 Surfactant—an alkyl polyglycoside in which the alkyl group contains 8 to 10 carbon atoms and having an average degree of polymerization of 1.7.
3. GLUCOPON® 600 Surfactant—an alkyl polyglycoside in which the alkyl group contains 12 to 16 carbon atoms and having an average degree of polymerization of 1.4.
4. GLUCOPON® 625 Surfactant—an alkyl polyglycoside in which the alkyl group contains 12 to 16 carbon atoms and having an average degree of polymerization of 1.4.
5. APG® 325 Surfactant—an alkyl polyglycoside in which the alkyl group contains 9 to 11 carbon atoms and having an average degree of polymerization of 1.6.
6. PLANTAREN® 2000 Surfactant—an alkyl polyglycoside in which the alkyl group contains 8 to 16 carbon atoms and having an average degree of polymerization of 1.4.
7. PLANTAREN® 1300 Surfactant—an alkyl polyglycoside in which the alkyl group contains 12 to 16 carbon atoms and having an average degree of polymerization of 1.6.
8. AGRIMUL® PG 2067 Surfactant—an alkyl polyglycoside in which the alkyl group contains 8 to 10 carbon atoms and having an average degree of polymerization of 1.7.

Other examples include alkyl polyglycoside surfactant compositions which are comprised of mixtures of compounds of formula I as described in U.S. Pat. Nos. 5,266,690 and 5,449,763, the entire contents of both of which are incorporated herein by reference.

A particularly preferred nonionic sugar surfactant for use in the present invention is an alkyl polyglycoside corresponding to formula II wherein $R_3$ is a monovalent organic radical having from about 8 to about 16 carbon atoms, b is zero, and a is a number having a value of from about 1 to about 2.

Electrolytes are generally defined as substances that will provide ionic conductivity when either dissolved in, or in contact with, water. Familiar types are sulfuric acid and sodium chloride. Examples of suitable electrolytes for use in the present invention include, but are not limited to, sodium chloride, sodium carbonate, sodium tripolyphosphate, sodium citrate, sodium acetate and nitrilotriacetic acid.

According to one embodiment of the present invention, there is provided a process for stabilizing an aqueous zeolite suspension involving: (a) providing an aqueous zeolite suspension; (b) providing a nonionic sugar surfactant, preferably an alkyl polyglycoside; (c) providing an electrolyte; and (d) adding (b) and (c) to (a).

The nonionic sugar surfactant will typically be added to the aqueous zeolite suspension in an amount of from about 0.25 to about 10% by weight, preferably from about 0.25 to about 5% by weight, and most preferably from about 0.25 to about 2% by weight, based on the weight of the suspension.

Similarly, the electrolyte will typically be added to the aqueous zeolite suspension in an amount of from about 0.25 to about 10% by weight, preferably from about 0.5 to about 5% by weight, and most preferably from about 0.5 to about 2% by weight, based on the weight of the suspension.

The method of introducing the nonionic sugar surfactant and the electrolyte into the zeolite suspension is not critical, and may be carried out, for example, mechanically by stirring at a temperature ranging from about 10° to about 60° C. and preferably from about 20° to about 35° C.

The stabilized aqueous zeolite slurry formed according to the process of the present invention will have a viscosity ranging from about 3,000 to about 40,000 centipoise, -(cpi) and preferably from about 5,000 to about 25,000 centipoise -(cpi).

The present invention will be better understood from the examples which follow, all of which are intended to be illustrative only, and are not meant to unduly limit the scope of the invention in any way.

EXAMPLES

Varying amounts of alkyl polyglycosides and electrolytes were added to an aqueous zeolite suspension containing 62% by weight of zeolite. The samples were then tested to determine both their viscosity and their degree of stabilization. The specific components and amounts thereof used to formulate the examples are found in Tables I and II, below.

TABLE I

| Ex. | %/wt. GLUCOPON ® 600 | %/wt $Na_2CO_3$ | %/wt other | Viscosity (cpi) | Observations |
|---|---|---|---|---|---|
| 1 | 1.0 | 0 | 0 | ND | split |
| 2 | 1.0 | 1.0 | 0 | 12,400 | OK |
| 3 | 0 | 1.0 | 0 | ND | split |
| 4 | 0 | 1.0 | 0 | ND | split |
| 5 | 1.5 | 1.0 | 0 | 14,600 | OK |
| 6 | 1.0 | 2.0 | 0 | 18,000 | OK |
| 7 | 2.0 | 0 | 0 | 90,000 | OK |
| 8 | 2.0 | 0.5 | 0 | 75,200 | OK |
| 9 | 2.0 | 1.0 | 0 | 18,000 | OK |
| 10 | 0.5 | 1.0 | 1.0 STPP | 28,700 | OK |
| 11 | 0.5 | 0 | 1.0 K acetate | 19,700 | OK |
| 12 | 0.5 | 0 | 1.0 NTA | 43,000 | OK |
| 13 | 0.5 | 0 | 1.0 NaCl | 42,900 | OK |
| 14 | 0.5 | 0 | 7.0 NaCl | 5,500 | OK |

GLUCOPON ® 600 = an alkyl polyglycoside in which the alkyl group contains 12 to 16 carbon atoms and having an average degree of polymerization of 1.4.
STPP = sodium tripolyphosphate.
NTA = nitrilotriacetic acid.
ND = viscosity not determined due to phase separation.

TABLE II

| Ex. | % GLUCOPON ® 225 | % $Na_2CO_3$ | % Other | Viscosity | Observations |
|---|---|---|---|---|---|
| 15 | 1.0 | 0 | 0 | ND | split |
| 16 | 0.5 | 1.0 | 0 | 28,000 | OK |
| 17 | 0.25 | 1.0 | 0 | 28,000 | OK |
| 18 | 0.25–1.0 | 2.0 | 0 | >100,000 | too thick to pump |
| 19 | 1.0 | 0.5–1.0 | 0 | 11,300 | OK |
| 20 | 1.0 | 0 | 1.0 Na citrate | <2,000 | too thin |
| 21 | 0.5 | 0 | 1.0 Na citrate | <2,000 | too thin |
| 22 | 0.5 | 0 | 2.0 Na citrate | 35,000 | Thick |

As can be seen from the data above, those aqueous zeolite slurries containing both a nonionic sugar surfactant and an electrolyte yield superior stability ratings.

What is claimed is:

1. A process for making a stabilized aqueous zeolite suspension comprising:

(a) providing an aqueous zeolite suspension;

(b) providing at least one nonionic sugar surfactant selected from the group consisting of an alkyl polyglycoside, a polyhydroxy fatty acid amide, and mixtures thereof;

(c) providing at least one electrolyte; and (d) adding the sugar surfactant and electrolyte to the aqueous zeolite suspension to form a stabilized aqueous zeolite suspension.

2. The process of claim 1 wherein the aqueous zeolite suspension of part (a) has a solids content of from about 40 to about 80% by weight.

3. The process of claim 1 wherein the nonionic sugar surfactant is an alkyl polyglycoside corresponding to formula II:

$$R_3O(R_4O)_b(Z)_a \quad \text{(II)}$$

wherein $R_3$ is a monovalent organic radical having from about 6 to about 30 carbon atoms; $R_4$ is a divalent alkylene radical having from 2 to 4 carbon atoms; Z is a saccharide residue having 5 or 6 carbon atoms; b is a number having a value from 0 to about 12; a is a number having a value from 1 to about 6.

4. The process of claim 3 wherein in formula II, $R_3$ is a monovalent organic radical having from about 8 to about 16 carbon atoms, b is zero, and a is a number having a value of from about 1 to about 2.

5. The process of claim 1 wherein the nonionic sugar surfactant is a polyhydroxy fatty acid amide.

6. The process of claim 1 wherein the nonionic sugar surfactant is added to the aqueous zeolite suspension in an amount of from about 0.25 to about 10% by weight, based on the weight of the suspension.

7. The process of claim 1 wherein the electrolyte is added to the aqueous zeolite suspension in an amount of from about 0.25 to about 10% by weight, based on the weight of the suspension.

8. The process of claim 1 wherein the nonionic sugar surfactant and zeolite are added to the aqueous zeolite suspension at a temperature of from about 10° to about 60° C.

9. The process of claim 1 wherein the stabilized aqueous zeolite suspension has a viscosity ranging from about 3,000 to about 40,000 cpi.

10. A process for making a stabilized aqueous zeolite suspension comprising:

(a) providing an aqueous zeolite suspension having a solids content of from about 55 to about 65% by weight;

(b) providing from about 0.25 to about 2% by weight of an alkyl polyglycoside corresponding to formula II:

$$R_3O(R_4O)_b(Z)_a \quad \text{(II)}$$

wherein $R_3$ is a monovalent organic radical having from about 8 to about 16 carbon atoms; $R_4$ is a divalent alkylene radical having from 2 to 4 carbon atoms; Z is a saccharide residue having 5 or 6 carbon atoms; b is zero; a is a number having a value from about 1 to about 2;

(c) providing from about 0.5 to about 2% by weight of at least one electrolyte; and (d) adding the alkyl polyglycoside and electrolyte to the aqueous zeolite suspension, at a temperature of from about 20° to about 35° C.

11. A stabilized aqueous zeolite suspension consisting essentially of:

(a) an aqueous zeolite suspension having a solids content of zeolite ranging from about 40 to about 80% by weight;

(b) at least one nonionic sugar surfactant selected from the group consisting of an alkyl polyglycoside, a polyhydroxy fatty acid amide, and mixtures thereof; and (c) at least one electrolyte.

12. The suspension of claim 11 wherein the nonionic sugar surfactant is an alkyl polyglycoside corresponding to formula II:

$$R_3O(R_4O)_b(Z)_a \quad \text{(II)}$$

wherein $R_3$ is a monovalent organic radical having from about 6 to about 30 carbon atoms; $R_4$ is a divalent alkylene radical having from 2 to 4 carbon atoms; Z is a saccharide residue having 5 or 6 carbon atoms; b is a number having a value from 0 to about 12; a is a number having a value from 1 to about 6.

13. The suspension of claim 12 wherein in formula II, $R_3$ is a monovalent organic radical having from about 8 to about 16 carbon atoms, b is zero, and a is a number having a value of from about 1 to about 2.

14. The suspension of claim 11 wherein the nonionic sugar surfactant is a polyhydroxy fatty acid amide.

15. The suspension of claim 11 wherein the nonionic sugar surfactant is present in the suspension in an amount of from about 0.25 to about 10% by weight, based on the weight of the suspension.

16. The suspension of claim 11 wherein the electrolyte is present in the suspension in an amount of from about 0.25 to about 10% by weight, based on the weight of the suspension.

17. The suspension of claim 11 having a viscosity ranging from about 3,000 to about 40,000 cpi.

18. A stabilized aqueous zeolite suspension consisting essentially of:

(a) from about 55 to about 65% by weight of an aqueous zeolite suspension;

(b) from about 0.25 to about 2% by weight of an alkyl polyglycoside corresponding to formula II:

$$R_3O(R_4O)_b(Z)_a \quad \text{(II)}$$

wherein $R_3$ is a monovalent organic radical having from about 8 to about 16 carbon atoms; $R_4$ is a divalent alkylene radical having from 2 to 4 carbon atoms; Z is a saccharide residue having 5 or 6 carbon atoms; b is zero; a is a number having a value from about 1 to about 2; and (c) from about 0.5 to about 2% by weight of at least one electrolyte.

* * * * *